United States Patent [19]

Palmersten

[11] Patent Number: 4,998,396

[45] Date of Patent: Mar. 12, 1991

[54] INTERLOCKING PANELS

[76] Inventor: Michael J. Palmersten, 3110 Hillside La., Safety Harbor, Fla. 34695

[21] Appl. No.: 504,488

[22] Filed: Apr. 4, 1990

[51] Int. Cl.[5] ..... E04B 1/80; E04C 1/10

[52] U.S. Cl. ..... 52/595; 52/580; 52/588; 52/594

[58] Field of Search ..... 52/588, 592, 594, 595, 52/582, 584, 580, 309.9, 309.11

[56] References Cited

U.S. PATENT DOCUMENTS

| | | | |
|---|---|---|---|
| 3,386,218 | 6/1968 | Scott | 52/595 X |
| 3,397,496 | 8/1968 | Sohns | 52/595 X |
| 4,360,553 | 11/1982 | Landheer | 52/595 X |
| 4,769,963 | 9/1988 | Meyerson | 52/309.9 |
| 4,936,078 | 6/1990 | Porter | 52/595 |

FOREIGN PATENT DOCUMENTS

| | | | |
|---|---|---|---|
| 1571961 | 6/1969 | France | 52/595 |

*Primary Examiner*—Richard E. Chilcot, Jr.

[57] ABSTRACT

Building panels having foam cores covered by protective thin sheets of metal are interlocked at abutting edges by mating parts of the metal sheets. In a first embodiment, a first panel has an outwardly projecting tongue formed in an edge wall. The tongue abuts a flat edge wall of a second panel when the respective metal parts of the panels are interlocked. Sufficient play is provided to allow lateral movement of the interlocked panels to facilitate the construction of a structure that employs the panels. One of the interlocking metal plates is in the form of a trough so that if water enters a seam between the panels, such water is directed by the trough to a gutter. In a second embodiment, the tongue is formed in the second panel and channels are provided in the second panel to receive inwardly projecting, curled metal parts that engage complementally formed metal parts of the first panel.

5 Claims, 4 Drawing Sheets

FIG. 1

INTERLOCKING PANELS

TECHNICAL FIELD

This invention relates, generally, to commercial and architectural panels. More particularly, it relates to panels having interlocking edges.

BACKGROUND ART

Numerous edge-to-edge interlocking panel constructions are known. In one type of construction, two edge-abutting panels are interlocked to one another by a separate interlocking member such as an elongate, extruded track member. In another type of construction, the confronting edges of the panels are complementally formed for direct mating engagement in the absence of a separate interlocking means.

This invention relates to the second type of construction.

One of the most important drawbacks of prior art interlocking panels is that they cannot move laterally easily once interlocked. In installations requiring lateral relative movement between interlocked panels, the panels of the prior art require striking with a sledge hammer to effect the desired lateral displacement. Thus, there is a need for interlocking panels having lateral movement capability.

Moreover, the known interlocking panels are structurally complex and thus expensive to manufacture. Accordingly, there is a need for a panel design of elegant construction.

The prior art, taken as a whole, neither teaches nor suggests how the limitations of the earlier designs could be overcome.

DISCLOSURE OF INVENTION

The interlocking panels of this invention have cores formed of expanded polystyrene, urethane or other suitable material. The flat top and bottom surfaces of the cores are covered by a thin sheet of flexible metal to protect such relatively soft cores from abrasion.

The foam core of a first panel has an integral, outwardly projecting tongue member of rectilinear configuration formed along one or more preselected edges of the panel. The tongue has the same thickness as the core from which it projects and is positioned equidistant from the top and bottom walls of the panel.

In a first embodiment, the protective metal covers of the first, tongued panel are bent a first time at right angles at the edge of the panel to overlie and protect the parts of the panel edge above and below the tongue. Each metal cover is bent a second time in a return bend or curled configuration to protect the top and bottom surfaces of the projecting tongue and to perform an interlocking function. The outermost flat edge of the tongue is not covered.

A second panel has a flat edge with no projecting tongue and having no tongue-receiving groove. The respective metal covers for the top and bottom surfaces of the second panel project beyond the flat edge of the core by a predetermined distance substantially equal to the amount of projection of the tongue of the first panel. A first right angle bend is formed in each metal cover at its outermost edge and the respective distal free ends of said metal edges are inwardly curled.

Thus, when the edges of the first and second panels are brought together, the outwardly curled distal free ends of the first panel's metallic covers slidingly engage the inwardly curled edges of the second panel's protective covers and transiently displace said inwardly projecting curled edges so that they momentarily diverge from one another. After the leading end of each outwardly projecting curl has slid over its inwardly curled counterpart, the respective free ends of the curled parts interlock with one another. The tongue of the first panel tightly abuttingly engages the flat edge of the second panel, thereby enhancing the structural integrity of the joined panels. Since the tongue and the respective curled metal covers are positioned inwardly of the top and bottom surfaces of their respective panels, said parts are not visible when a pair of panels are interlocked to one another. In a second embodiment, the tongue is not provided on the edge of the first panel, but the configuration of the edge-overlying and outwardly extending curled metallic parts is the same as in the first embodiment. The second panel has a tongue, and the second panel has inwardly projecting curled metallic interlocking parts, but said parts are spaced from the tongue and do not abuttingly overlie the top and bottom wells of the tongue. The inwardly projecting curls are received within associated channels formed in the edge of the tongue-carrying second panel. Thus, the foam extends to and abuts the downwardly and upwardly bent parts of the top and bottom metallic covers, respectively. Thus, when adjacent panels are interlocked, the outwardly projecting curls of the first panel overlie the top and bottom surfaces of the tongue and interlock with the inwardly projecting curls.

In both embodiments, the panels lock together tightly, but there is sufficient play therebetween to allow laterally directed relative motion between interlocked panels to facilitate their interconnection in certain installations.

The final installation of the novel panels substantially insures against water leakage between the panel seams, but if water does penetrate the seams, the curled edges of the metal sheet that covers the tongued panel serve as a trough that directs such water to a gutter.

It is therefore understood that an important object of this invention is to provide interlocking panels having the capability to move laterally with respect to one another when they are interlocked.

Another object is to provide interlocking panels that include a trough means that carries away any water that might leak between the seams between the panels.

Still another object is to provide interlocking panels of elegant construction that are economical to manufacture.

These and other advantages and features of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
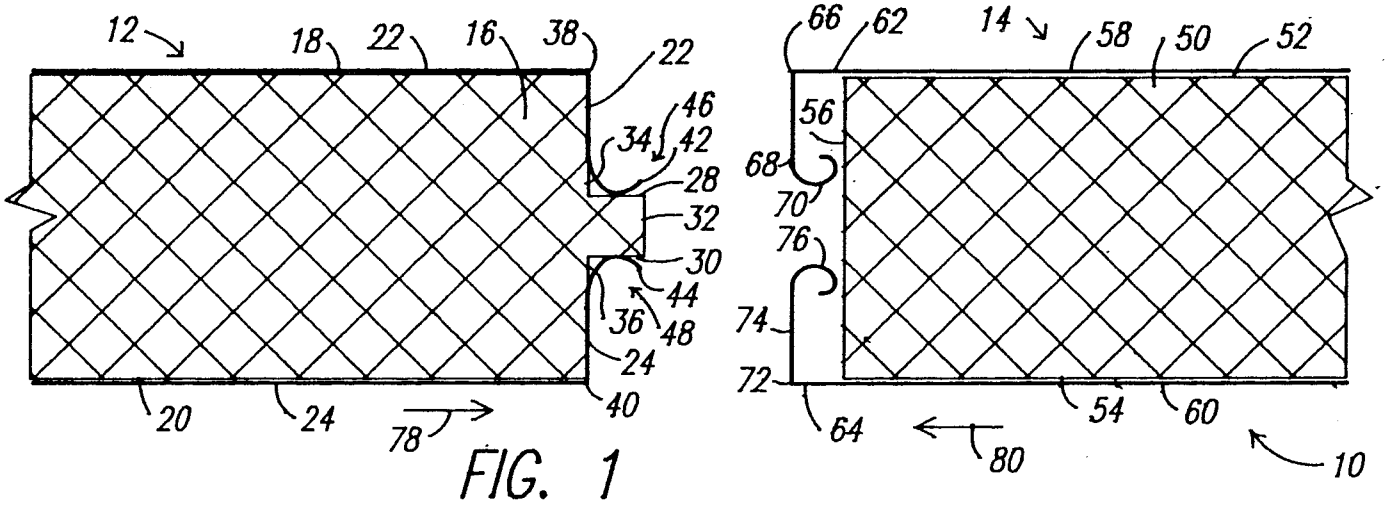
FIG. 1 is a side elevational view of a first embodiment of the novel panels in their spaced apart configuration.

Referring now to FIG. 1, it will there be seen that a first embodiment of the novel interlocking panels is denoted as a whole by the reference numeral 10. Assembly 10 includes a first panel denoted 12 and a second panel denoted 14.

First panel 12 includes a core 16 which may be of any suitable material such as expanded polystyrene or urethane, e.g. Core 16 includes top wall 18 and bottom wall 20 which are covered by a thin metal sheet 22, 24, respectively. Panels having foam cores disposed in sandwiched relation between protective metal sheets are known.

One or more edges of core 16 has an outwardly projecting, integrally formed, laterally extending tongue 26. Tongue 26 includes a top surface 28, a bottom surface 30 and a distal free edge 32. Top surface 28 is disposed orthogonally to edge wall 34 and bottom surface 30 is normal to edge wall 36 of the panel.

Edge walls 34 and 36 of panel 12 are protectively covered by metal sheets 22 and 24, respectively, each of said sheets having a right angle bend formed therein at the upper and lower edges of the panel as at 38, 40, respectively.

The distal free end of top sheet 22 has an outwardly extending curl 42 formed therein along its entire lateral extent. The outward extent of curl 42 is substantially equal to the outward extent of tongue 26 as shown. The bight region 46 of curl 42 overlies and is supported by top surface 28 of tongue 26.

Similarly, the distal free end of bottom sheet 24 is formed into an outward extending curl 44; bight region 48 thereof overlies and is supported by bottom wall 30 of tongue 26. Thus, only outer edge 32 of tongue 26 is completely uncovered by sheets 22, 24.

Importantly, curls 42, 44 are flexible and resilient.

Panel 14 has a foam core 50 having top surface 52, bottom surface 54 and flat edge 56.

A metal sheet 58 protectively overlies top surface 52 and metal sheet 60 overlies bottom surface 54. A part 62 of upper sheet 58 extends outwardly beyond edge 56 and a part 64 of lower sheet 60 extends the same distance beyond edge 56.

Part 62 has a right angle bend 66 formed therein as shown. Downwardly extending part 68 of sheet 58 extends downwardly a predetermined distance in parallelism to edge 56 and terminates in an inwardly projecting curl 70. Similarly, part 64 has a right angle bend 72 formed therein, and upwardly extending part 74 terminates in inwardly projecting curl 76.

Figure 3:
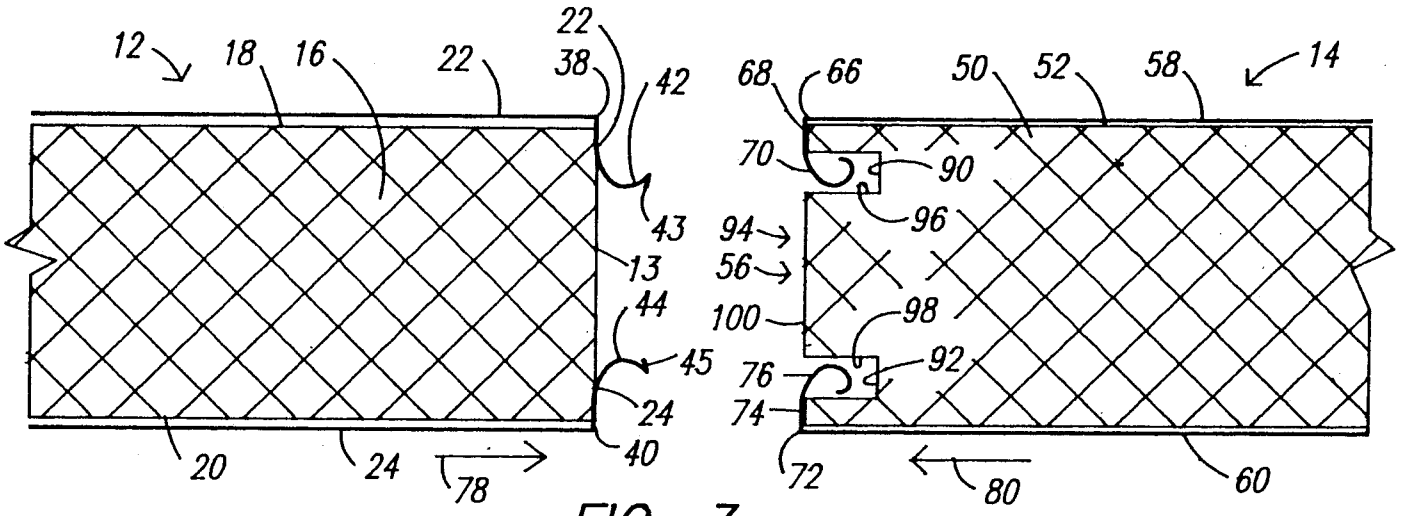
FIG. 3 is a side elevational view of a second embodiment of the novel panels in their spaced apart configuration.
Figure 4:
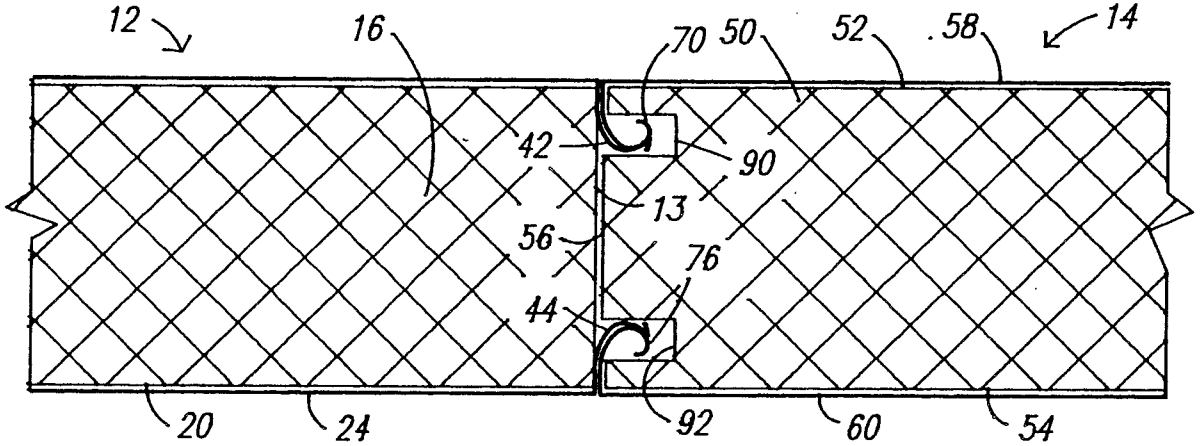
FIG. 4 is a side elevational view of the panels of FIG. 3 in their interlocked configuration.

Referring now to FIGS. 3 and 4 wherein a second embodiment is shown, it will there be seen that foam core 16 of the first panel 12 has a flat edge wall 13, i.e., no tongue is provided, but in many other respects first panel 12 of this second embodiment has a construction similar to panel 12 of the first embodiment as indicated by the shared reference numerals. Note that metal walls 22, 24 of the second embodiment have less extent than their first embodiment counterparts, and that curved parts 42, 44 terminate in barbs 43, 45, respectively.

Second panel 14 is also modified in this second embodiment. As with first panel 12, the configuration of the metallic sheets 58, 60 is substantially unchanged (parts 68 and 74 being shortened), but core 50 is modified. As shown in FIGS. 3 and 4, core 50 extends to and abuts downwardly extending part 68 and upwardly extending part 74. Moreover, a laterally extending first channel, generally denoted 90, is formed in said extended edge wall 56 of said core to accommodate inwardly projecting curl 70, and a second laterally extending channel, generally denoted 92, is formed in said core to accommodate inwardly projecting curl 76. Channels 90, 92 thereby form a tongue 94 having top wall 96, bottom wall 98 and edge wall 100. Note that curls 70, 76 are slightly spaced apart from walls 96, 98. When these panels are interlocked as shown in FIG. 4, outwardly projecting curls 42, 44 of panel 12 overlie said walls 96, 98, respectively, and serve as trough members for any water that might leak between the seams, as in the first embodiment.

To interconnect the panels 12, 14, of either the first or second embodiments, panel 12 is displaced in the direction of arrow 78 or panel 14 is displaced in the direction of arrow 80, or both. Curled members 70, 76 transiently diverge away from one another as trough members 42, 44 of the first panel slide therepast and trough members 42, 44 may give a slight amount as well, momentarily converging toward one another.

Figure 2:
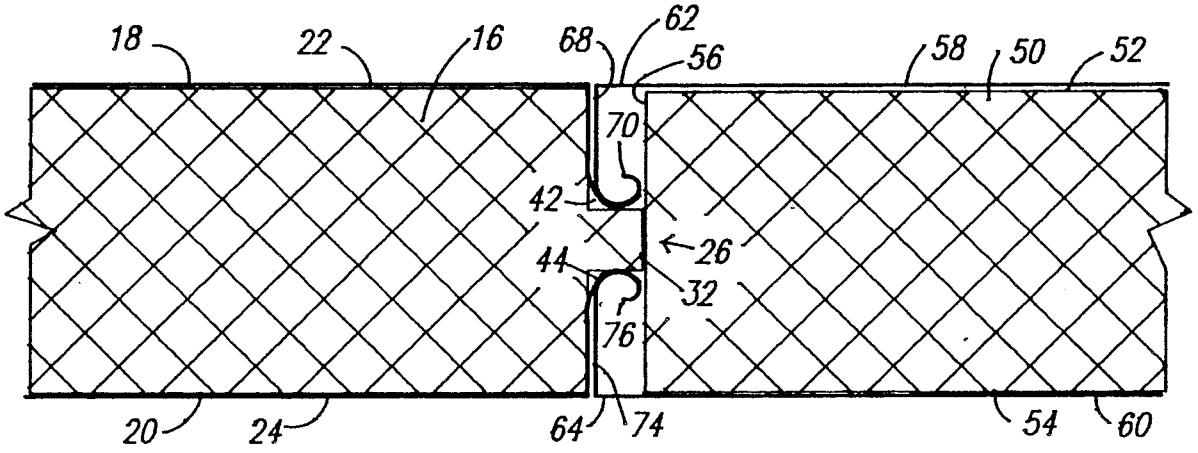
FIG. 2 is a side elevational view of the panels of FIG. 1 in their interlocked configuration.
Figure 5:
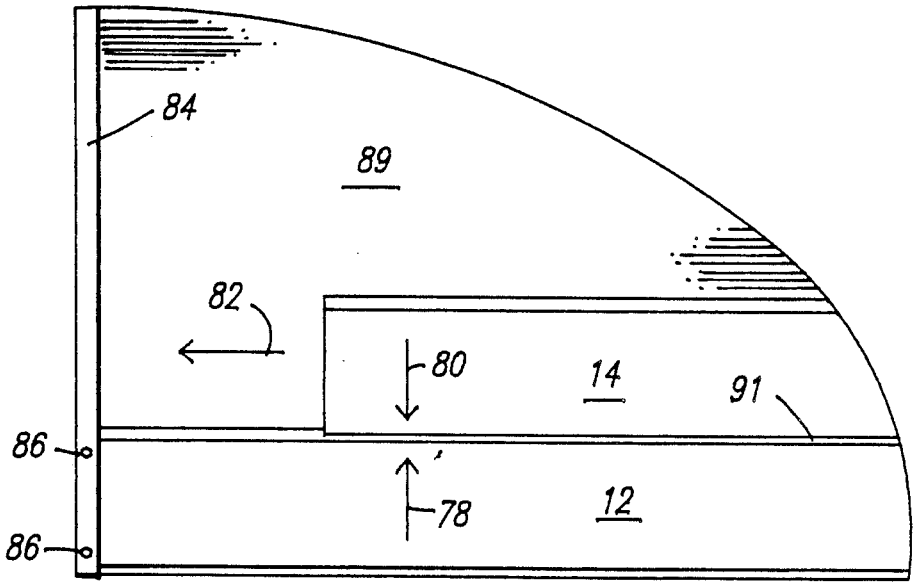
FIG. 5 is a top plan view of a typical panel installation, showing two interlocked panels before one of them is moved laterally.
Figure 8:
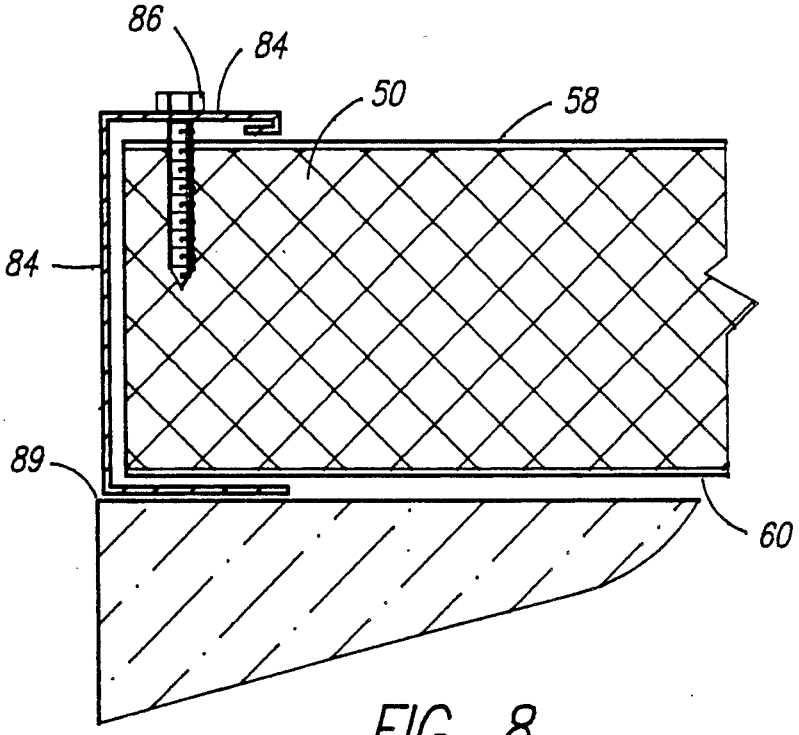
FIG 8 is a detailed sectional view taken along line 8—8 in FIG. 6.

FIGS. 2 and 4 show the interlocked configurations of the first and second embodiments of the panels, respectively. In many applications, as depicted in FIG. 3, the converging motion represented by confronting arrows 78, 80 in FIGS. 1 and 3 is followed by a lateral motion represented by arrow 82 in FIG. 5. Significantly, the novel construction shown herein is specifically designed to allow sufficient play in the structure to permit such lateral motion. Prior art interlocking panels cannot move laterally without difficulty, as mentioned earlier. Most installations include headers 84 (FIGS. 5, 6 and 8) to which a preselected edge of the panels are connected by suitable lug bolts 86, and it is the presence of such headers that necessitates bilateral motion.

Figure 6:
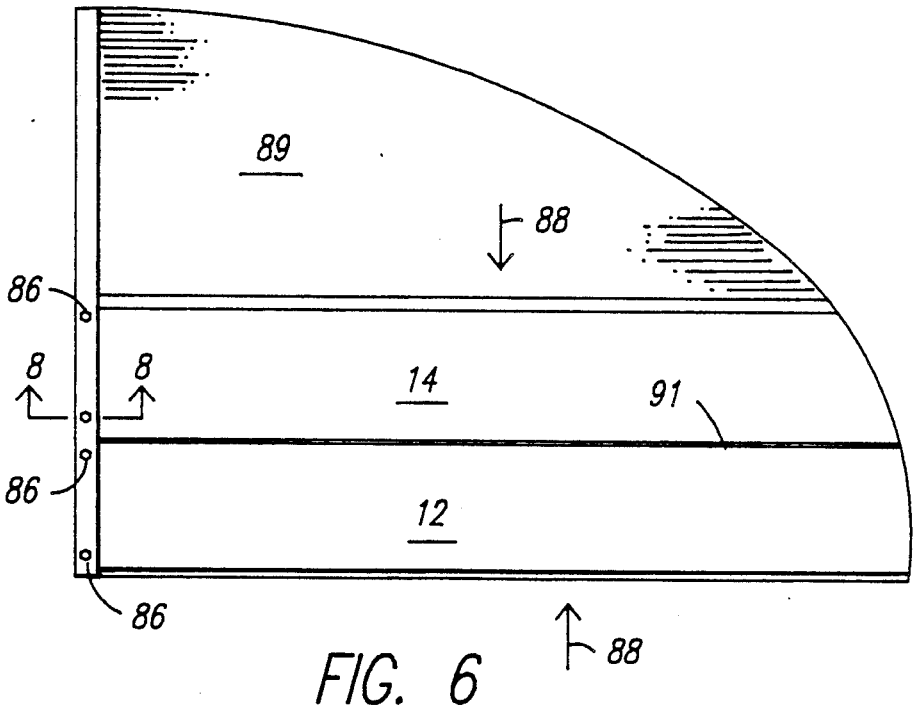
FIG. 6 is a view similar to FIG. 5, showing the panels in their fully installed configuration.

After the lateral motion has been completed, as shown in FIG. 6, opposite ends of the panels are shoved toward one another as indicated by confronting directional arrows 88, 88, so that seams 90 between panels 12, 14 are made substantially water tight.

In the event water is able to penetrate a seam 90, such water will collect in trough 42 or 44 and will drain therefrom to a gutter, not shown, because the panels are installed at an angle atop roof 89 to permit water runoff toward a gutter.

Figure 7:
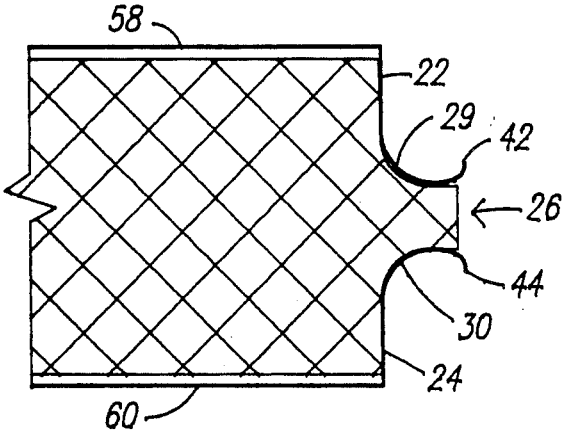
FIG. 7 is a s elevational view of a third embodiment.

A third embodiment is shown in FIG. 7. Top and bottom surfaces 28, 30 of tongue 26 are provided with concavities 29, 31, respectively, which receive trough members 42, 44 therein as shown. Moreover, the distal free ends 42, 44 of the metal sheets 22, 24, respectively, are formed in a return bend, or "J"-shape in this embodiment. In all other respects, this third embodiment does not differ from the first. Similar concavities may be formed in the tongue of the second embodiment as well.

Clearly, this invention is new and useful. Moreover, it was not obvious to those of ordinary skill in this art at the time this invention was made, in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A panel construction that facilitates edge-to-edge interlocking of panels, comprising:

a first panel;

said first panel having a flat top wall, a flat bottom wall, and a plurality of edge walls therebetween;

an outwardly extending tongue member formed in a preselected edge wall of said panel, said tongue member being coextensive with said preselected edge wall and being positioned equidistantly from said top and bottom walls;

said tongue member having a top wall, a bottom wall and an edge wall;

a first thin, flexible sheet of metal disposed in overlying relation to said panel top wall;

said first sheet of metal having a substantially right angle bend formed therein at said preselected panel edge wall, said first sheet having a downwardly extending part disposed in overlying relation to a part of said preselected panel edge wall above said tongue member top wall;

a first trough member formed integrally with said downwardly extending part, said first trough member being disposed in overlying relation to said tongue member top wall;

a second thin, flexible sheet of metal disposed in overlying relation to said panel bottom wall;

said second sheet of metal having a substantially right angle bend formed therein at said preselected panel edge wall, said second sheet having an upwardly extending part disposed in overlying relation to a part of said preselected panel edge wall below said tongue member bottom wall;

a second trough member formed integrally with said upwardly extending part, said second trough member being disposed in overlying relation to said tongue member bottom wall;

a second panel;

said second panel having a flat top wall, a flat bottom wall, and a plurality of flat edge walls therebetween;

a third thin, flexible sheet of metal disposed in overlying relation to said second panel top wall;

said third sheet extending outwardly beyond a preselected edge wall of said second panel in substantially coplanar relation to said second panel top wall;

a substantially right angle bend being formed in said third sheet at a preselected distance from said second panel preselected edge wall, said third sheet having a downwardly extending part disposed in parallelism to said second panel preselected edge wall;

said third sheet downwardly extending part including an integral, inwardly projecting curled distal free end;

a fourth, thin flexible sheet of metal disposed in overlying relation to said second panel bottom wall;

said fourth sheet extending outwardly beyond said preselected edge wall of said second panel in substantially coplanar relation to said second panel bottom wall and in parallelism to said third sheet;

a substantially right angle bend being formed in said fourth sheet at a preselected distance from said second panel preselected edge wall, said fourth sheet having an upwardly extending part disposed in parallelism to said second panel preselected edge wall and in substantially coplanar relation to the downwardly extending part of said third sheet;

said fourth sheet upwardly extending part including an integral, inwardly projecting curled distal free end;

said downwardly extending parts of said first, second, third and fourth sheets being substantially equal in extent to one another;

whereby edge-to-edge interlocking of said first and second panels is accomplished when said tongue member edge wall is placed into abutting relation to said preselected edge wall of said second panel.

2. A panel construction that facilities edge-to-edge interlocking of panels, comprising:

a first panel having a foam core;

said first panel having flat top, bottom and edge walls;

a first sheet of metal disposed in overlying relation to said first panel top wall;

said first sheet having a laterally extending right angle bend formed therein at an upper edge of said first panel;

said first sheet having a downwardly and laterally extending straight part that at least in part overlies an upper, laterally extending part of an edge wall of said first panel;

said first sheet straight part terminating in an integrally formed, laterally extending, outwardly projecting curved interlocking means;

a second sheet of metal disposed in overlying relation to said first panel bottom wall;

said second sheet of metal having a laterally extending right angle bend formed therein at a lower edge of said first panel;

said second sheet having a downwardly and laterally extending straight part that at least in part overlies a lower, laterally extending part of an edge wall of said first panel;

said second sheet straight part terminating in an integrally formed, laterally extending, outwardly projecting curved interlocking means;

a second panel having a foam core;

said second panel having flat top, bottom and edge walls;

a first laterally extending channel formed in a preselected edge wall of said second panel foam core;

a second laterally extending channel formed in a preselected edge wall of said second panel foam core;

a third sheet of metal overlying said second panel top wall;

said third sheet having a laterally extending right angle bend formed therein at an upper edge of said panel;

said third sheet having a downwardly and laterally extending straight part that at least in part overlies an upper, laterally extending part of an edge wall of said second panel;

said third sheet straight part terminating in an integrally formed, laterally extending, inwardly projecting curved interlocking means;

a fourth sheet of metal overlying said second panel bottom wall;

said fourth sheet having a laterally extending right angle bend formed therein at a lower edge of said second panel;

said fourth sheet having an upwardly and laterally extending straight part that at least in part overlies a lower, laterally extending part of an edge wall of said second panel;

said fourth sheet straight part terminating in an integrally formed, laterally extending, inwardly projecting curved interlocking means.

3. The panel construction of claim 2, wherein the respective downwardly extending parts of said first and third sheets have substantially the same extent.

4. The panel construction of claim 3, wherein the respective upwardly extending parts of said first and third sheets have substantially the same extent.

5. The panel construction of claim 4, wherein said outwardly projecting curved interlocking means of said first panel are fully received within said first and second channels when said first and second panels are interlocked.

* * * * *